US005143356A

United States Patent [19]

Wittebrood

[11] Patent Number: 5,143,356

[45] Date of Patent: Sep. 1, 1992

[54] SINTERING MACHINE

[75] Inventor: Hubertus A. J. Wittebrood, Neerhugowaard, Netherlands

[73] Assignee: Hoogovens Groep BV, Ijmuiden, Netherlands

[21] Appl. No.: 714,831

[22] Filed: Jun. 13, 1991

[30] Foreign Application Priority Data

Jun. 19, 1990 [NL] Netherlands ..... 9001386

[51] Int. Cl.[5] ..... C21B 7/16

[52] U.S. Cl. ..... 266/179; 266/279

[58] Field of Search ..... 266/177, 178, 179, 279

[56] References Cited

U.S. PATENT DOCUMENTS

| | | | |
|---|---|---|---|
| 2,213,396 | 9/1940 | Hyde et al. | 266/179 |
| 3,172,936 | 3/1965 | Koontz | 266/179 |
| 3,381,949 | 5/1968 | Rowen | 266/179 |
| 4,408,987 | 10/1983 | Oyler | 266/179 |

FOREIGN PATENT DOCUMENTS

| | | |
|---|---|---|
| 2825369 | 12/1978 | Fed. Rep. of Germany . |
| 3023061 | 1/1982 | Fed. Rep. of Germany . |
| 2458726 | 1/1981 | France . |
| 1146346 | 3/1969 | United Kingdom . |
| 1413626 | 11/1975 | United Kingdom . |

*Primary Examiner*—Scott Kastler

*Attorney, Agent, or Firm*—Stevens, Davis, Miller & Mosher

[57] ABSTRACT

A sintering machine having a train of grate cars containing grates for supporting material to be sintered, rails along which the grate cars travel, a plurality of suction boxes arranged beneath the travel path of the grate cars and connected to suction means so as to create a partial vacuum beneath the grates, and sealing means for sealing the suction boxes to the grate cars. To reduce air leakage, the sealing means comprises, at atleast one side of said grate cars, a casing structure enclosing the rail and provided with at least one flexible air seal to the grate cars.

6 Claims, 3 Drawing Sheets

SINTERING MACHINE

BACKGROUND OF THE INVENTION

1. Field of the Invention

The invention relates to a sintering of the downdraught type, comprising a train of grate cars travelling along support means, e.g. rails. The grate cars are provided with grates to carry material to be sintered. Suction boxes, known as windboxes, are arranged to create a partial vacuum under the grates of the grate cars during operation of suction means, so as to produce a downward draught through the material being sintered.

2. Description of the Prior Art

A machine of this type is known for example from Kawasaki Steel Technical Report No. 15 of October 1986, pages 9 to 15. A problem of this known sintering machine is so-called false air which is sucked along by the fan. False air is understood to be air that is not sucked through the material to be sintered, but for example through the space between the suction boxes and the support means for the train of grate cars as well as through the spaces between the grate cars themselves.

In this prior art article various measures are proposed to reduce the quantity of false air. The sintering machine is provided with one or more bars under each grate car, which bars are urged in the direction of a guideway connected to the fixed structure by spring force. Guideway and bar together provide a gastight seal. This gastight sealing function is usually further supported by applying fat or a plastics material between the bar and the guideway. Nevertheless some leakage is possible via the part situated between the bar and the grate car. As a solution to this, the prior art article mentions the application of a special seal in the space between the bar and the grate car.

In addition to complexity, a disadvantage of the measures mentioned is also the fact that maintaining the gastight seal requires intensive maintenance as a consequence of the strongly abrasive ambient conditions. For this maintenance the grate cars have to be removed wholly.

GB-A-1 146 346 shows a side sealing structure for grate cars in a different form of sintering machine in which air is forced upwardly through the grates from windboxes below them to a collection hood above them. The problems of sealing of the hood to prevent escape of gas, e.g. sulphur dioxide, are obviously different from those of a down-draught sintering machine. A tunnel structure is provided at each side around the wheels of the grate cars, with seals against the grate cars to both the hood space and the space beneath the grates.

SUMMARY OF THE INVENTION

The object of the invention is to minimize the false air described above in a downdraught sintering machine, and thereby to reduce operational costs by reducing the power required for suction. It may also increase production capacity.

Surprisingly it has been found in accordance with the invention that by a simple measure, the complicated structure known in the prior art to avoid false air can be at least partly omitted, and that further special advantages may be gained which will be explained below.

The sintering machine in accordance with the invention is characterised in that sealing means for sealing the suction boxes to the grate cars comprises, at at least one side of said grate cars, a casing structure enclosing the support means for the grate cars and provided with at least one flexible air seal to the grate cars.

Besides the fact that the structure of the invention provides a good seal to avoid false air, an important advantage of the sintering machine in accordance with the invention is that the flexible air sealing means are easily accessible during operation, which enables continuous maintenance of these sealing means without even the necessity of putting the sintering machine out of operation. With the known sintering machine this is not the case as stated. The design of the bar provided under each grate car dragging along the guideway, makes good maintenance of this known construction very difficult.

It is desirable for the flexible gastight coupling of the casing structure with the movable grate cars to comprise a combination of a brush seal and a flap seal, the flap seal comprising a flap which is connected to the casing structure on one side. The two types of sealing means support each other in their action, so that a sufficient seal against leakage is obtained in spite of the flexibility of the seal. Besides, in this way no high standards of accuracy have to be met for the tracking of the respective grate cars on their support, and movement of these grate cars both horizontally and vertically is allowed to a limited extent without loss of the seal. In particular a brush seal which is provided with one or more brushes, the bristles of which are of material selected from the stainless steel and polyurethane, gives good results. Such a seal provides good wear resistance at the high and varying temperatures that occur in a sintering machine, as a result of which the service life of the seal is sufficiently long.

A particular difficulty for application of a sealing casing structure, as proposed in accordance with the invention, is constituted by the longitudinal entry ends and exit ends of the grate cars. These entry ends and exit ends are separated approximately 50 meters. In accordance with a preferred aspect of the invention, a solution to this is found in that the sintering machine is provided with a blocking means within the casing structure at at least one of the entry and exit ends for the grate cars, which blocking means is provided with a passage for wheels of the grate cars of a shape such that at any time at least one wheel constitutes a seal in conjunction with the blocking means. Best results are achieved if at any time at least two successive wheels are present in the passage of the blocking means.

Preferably the casing structure has a further air seal to said grate cars, isolating the space within the casing structure from the partial vacuum beneath said grate cars. This improves the function of the casing as an isolation means. Preferably suction means are connected to the space within the casing structure to create a partial vacuum therein.

BRIEF INTRODUCTION OF THE DRAWINGS

An embodiment of the invention will now be described by way of non-limitative example, with reference to the accompanying drawings, in which.

DESCRIPTION OF THE PREFERRED EMBODIMENTS

Figure 1:
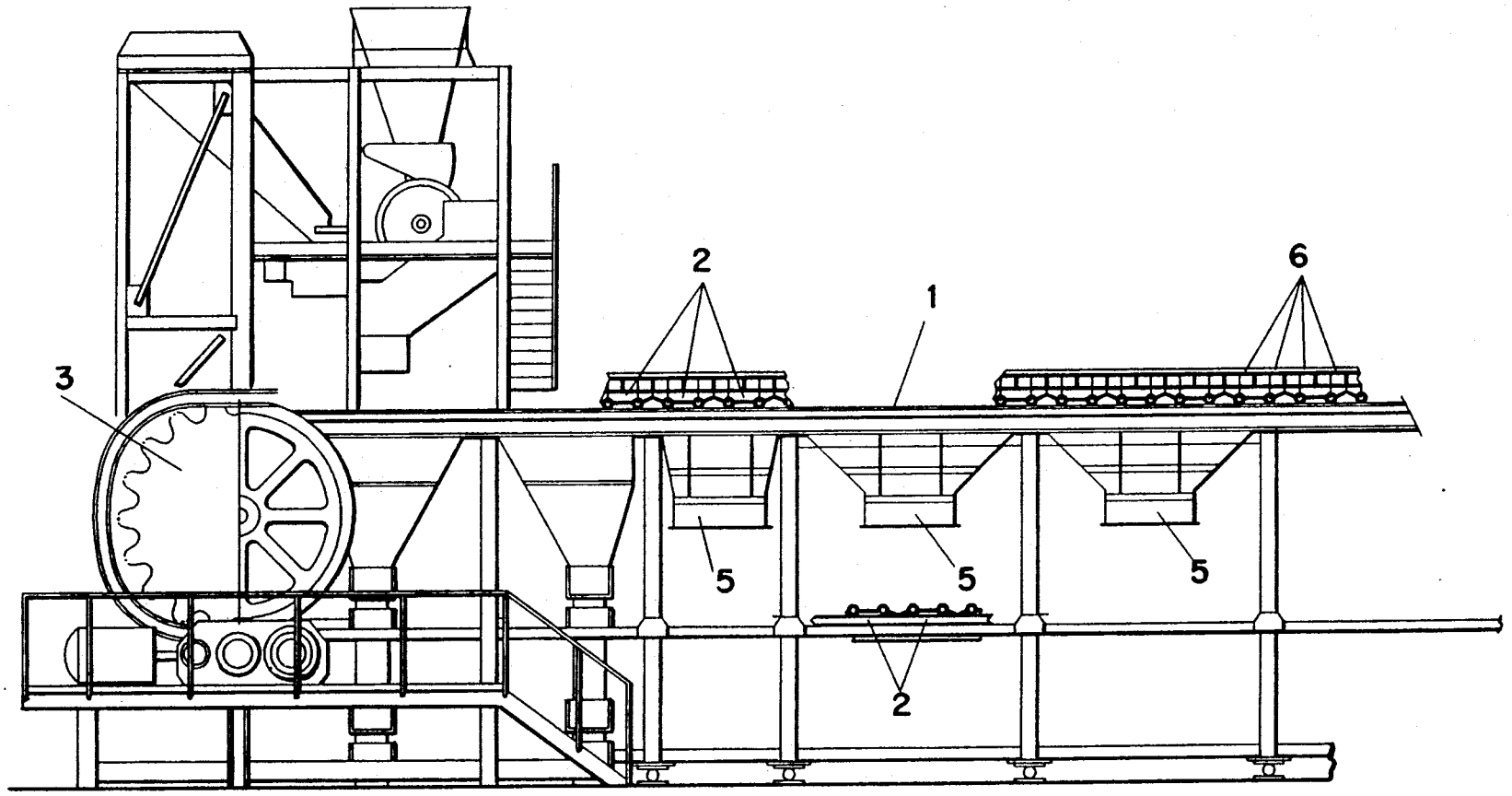
FIG. 1 shows a longitudinal section of a sintering machine to which the invention is applied.

In the downdraught sintering machine shown in the drawings, grate cars 2 travel in an endless train along supporting rails 1. The grate cars are guided round guide wheels at both ends of the sintering machine (only guide wheel 3 at the entry end of the sintering portion of the sintering machine is shown). The grate cars 2 are all provided with grates 6, on which typically a first layer of coarse sinter and on top of that further layers of an ore mix can be applied, which is processed into sinters in the sintering machine. Under the level of the rails 1 are suction boxes (windboxes) 5, which are connected to one or more exhaust fans (not shown), in such a way that a partial vacuum is created under the grates 6 of the grate cars 2. This causes a downward air draught through the mix which lies on the grates 6 and is to be sintered. At the same time a fuel, for example oil, coal or gas is burned near the entry end of the sintering portion of the sintering machine above the ore mix in order to ignite the upper layers of the ore mix lying on the grates 6 of the first grate cars 2. Owing to the draught brought about by the fans, a flame front moves through the ore mix downwards the grates 6. This is a relatively slow process. The lowest point at the level of the grates 6 is reached by this flame front just before the relevant grate car reaches the exit end of the sintering portion of the sintering machine and is guided round the guide wheel present there. As so far described, the sintering machine and its operation are conventional and further detail is not necessary.

The connection of the suction boxes 5 to the rails 1 and the grate cars 2 typically has gaps, due to which false air is also exhausted by the exhaust fan, which is at the expense of the quantity of air that is drawn through the sinter beds on the grates. With a better seal of the connection between the suction boxes 5 and the rails 1 and to the grate cars 2, a correspondingly lower power is required for the drive of the exhaust fan and the production capacity of the sintering machine can be raised to a higher level. In practice, it has been found that the quantity of false air drawn along can amount to approximately 30% relative to the total quantity of air passed by the exhaust fan. The invention reduces this substantially.

Figure 2:
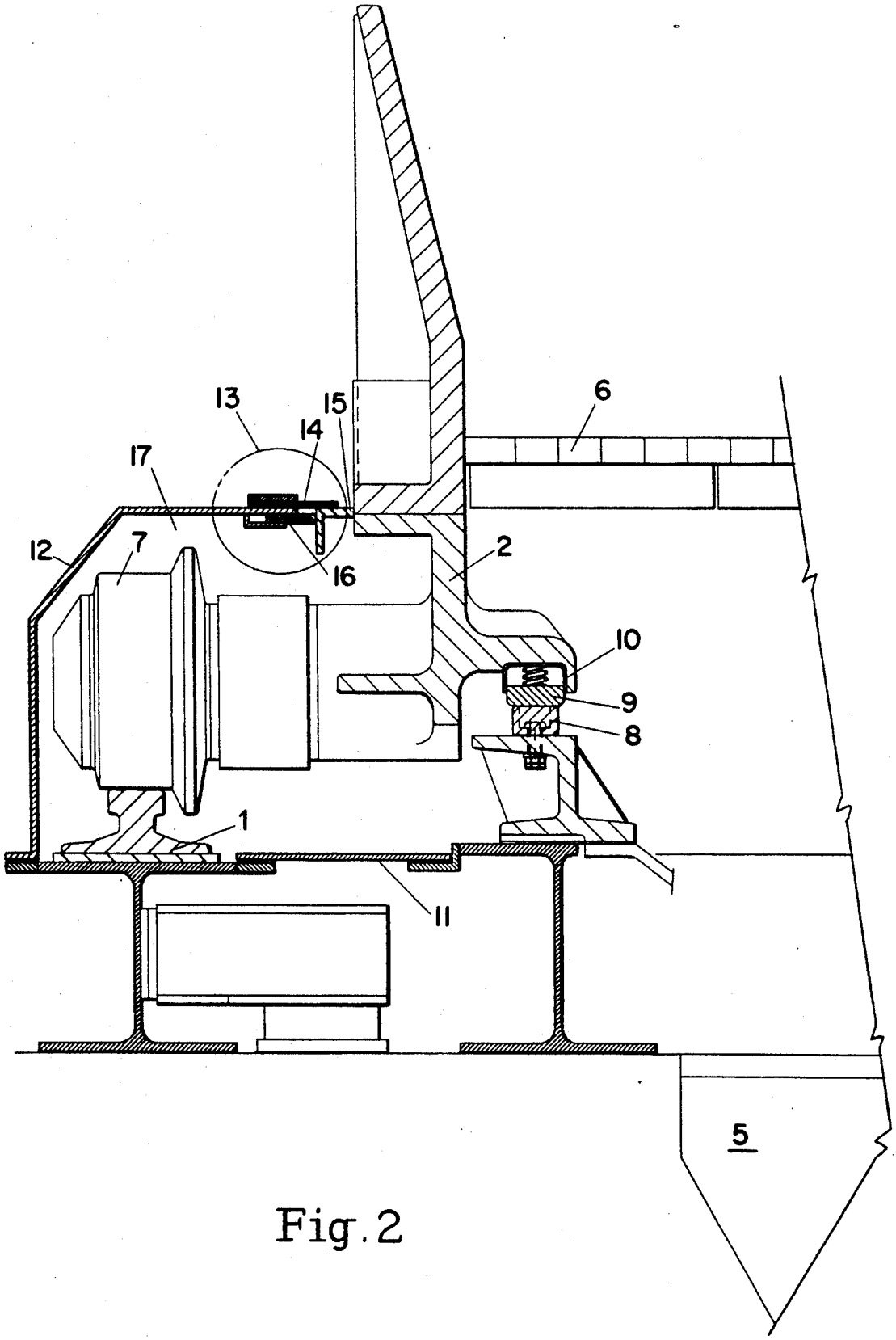
FIG. 2 shows a cross-section transverse to the grate car travel path of part of the sintering machine of FIG. 1 in accordance with the invention.

FIG. 2 shows how the grate car 2 is provided with axles with wheels 7, which run on the rails 1. The rails 1 are supported by a structure under which the suction boxes 5 are fitted. In known machine, air leakage is counteracted by manufacturing the grate cars accurately so as to obtain good-fitting push faces and by applying a longitudinal guideway 8 on both of the sintering machine as well as a bar 9 under each grate car 2 on both sides thereof. The bar 9 is urged onto the guideway 8 under the influence of a spring pressure. During operation of the sintering machine the bars 9 slide along the guideways 8. Usually fat is applied between each guideway 8 and bar 9 in order to improve the seal. Nevertheless, in this known design leakage still occurs. The following leakage paths are recognized:

between the push faces of the grate cars 2 themselves
between the co-acting guideway 8 and bar 9
between the housing 10 of the bar and the bar 9
between the bar housings 10 themselves
between the bar housing 10 and the grate car 2.

In accordance with the invention such leakage problems are for the greater part prevented by applying a sealing structure in the form of a casing 11, 12 which provides an air-tight connection with the fixed structure of the sintering machine at one side, in particular the suction boxes 5, and is provided with a flexible airtight coupling 13 with the grate cars 2 at its other edge. The casing 11,12 is essentially constituted by base wall 11 and side and top wall structure 12 extending around wheel 7 and rail 1. At the top, there is provided the flexible seal 13 which couples it to the grate cars 2.

This flexible seal or coupling 13 comprises a horizontal plastics material plate or flap 14 which is connected on one side to the wall structure 12 and which rests slidably on a mount 15 which is fixedly provided to each grate car 2. In addition the flexible seal 13 has a brush seal 16 with brush bristles of polyurethane or stainless steel. The brush seal 16 rubs along a surface of each grate car and ensures a wear-resisting seal under the operating conditions that occur in the sintering machine. There is thus an interior space 17 enclosed by the wall structure 11,12, the grate cars 2 and the seals at the entry and exit ends for the grate cars 2 described below. By virtue of the inner seal 8,9,10 described above, this interior space 17 is also isolated from the partial vacuum beneath the grates 6. Preferably an auxiliary suction fan is provided to put this interior space 17 under a partial vacuum. In this way an extra blockage of air leakage is achieved.

Figure 3:
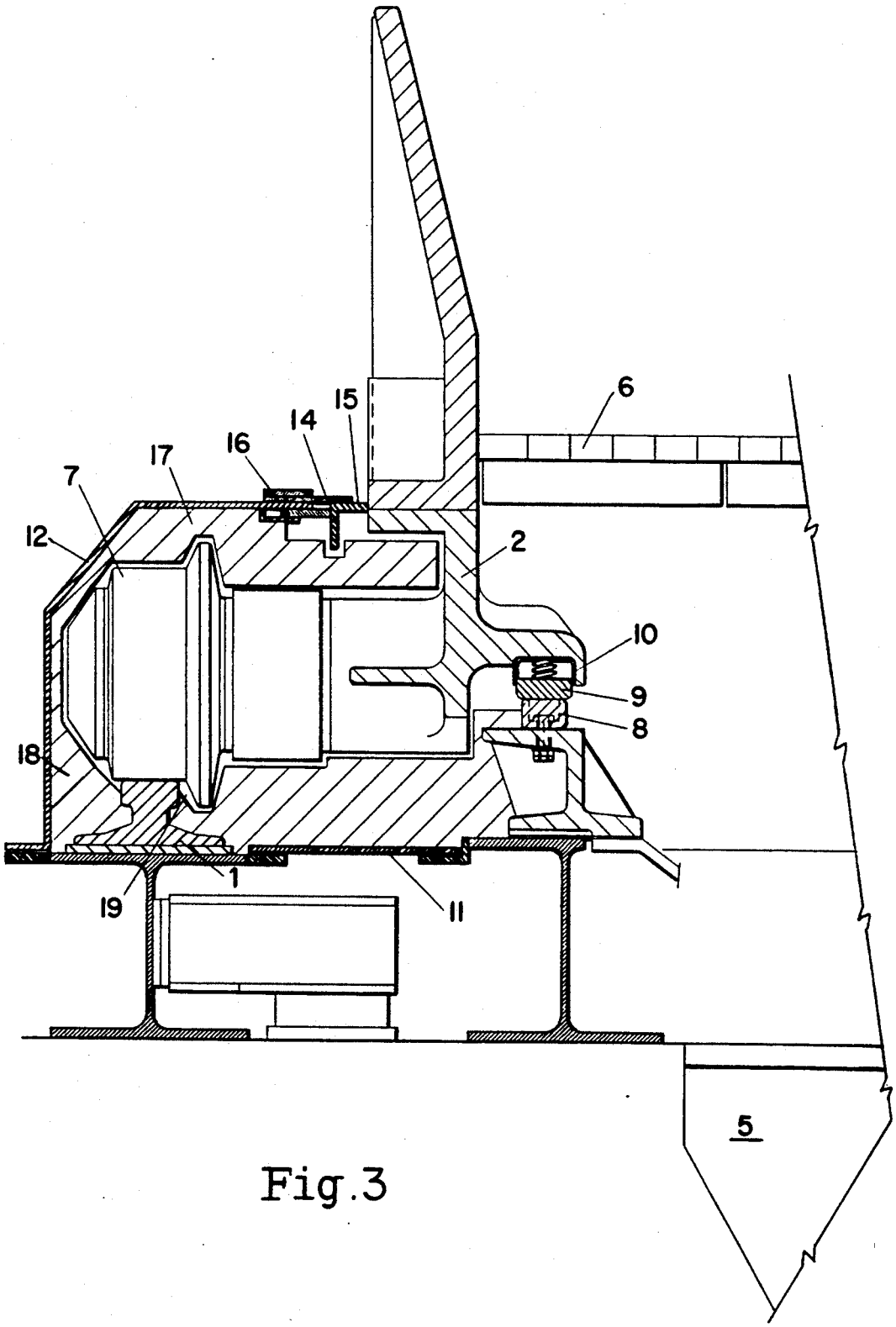
FIG. 3 shows a similar cross-section of FIG. 2 at the longitudinal end of the sealing casing structure provided in according with the invention.

At the entry and exit ends for the grate cars 2 of the sintering portion in the sintering machine, the interior space 17 of the casing 11,12 is provided as FIG. 3 shows, with a air-flow blocking means in the form of filler 18 made of polyurethane or other sufficiently heat-resistance synthetic material or a suitable metal structure. This filler 18 is provided with a recess or passage 19 for the carrying wheels 7 of the grate cars. This passage is of a length such that at any time at least one of the carrying wheels 7 is present in it and constitutes a seal in conjunction with the filler 18 minimizing air flow. The filler 18 preferably, as in this embodiment, extends so far that at any time two successive wheels 7 are present in the passage of the filler.

What is claimed is:

1. A sintering machine having a plurality of grate cars arranged in a train and containing grates for supporting material to be sintered, longitudinally extending support means along which said train of grate cars travels in a travel path, a plurality of suction boxes arranged beneath said travel path of the grate cars, suction means connected to said suction boxes to create a partial vacuum beneath said grates, and sealing means for sealing the suction boxes to said grate cars, said sealing means comprising, at at least one side of said grate cars, a casing structure enclosing said support means for the grate cars and being provided with at least one flexible air seal to said grate cars to restrict exterior air flow into said casing structure, said great cars having wheels running on said support means, and at at least one of its longitudinal ends, said casing structure being provided with blocking means for restricting longitudinal air flow, said blocking means including a passage along which said wheels pass, said passage being shaped to conform to the shape of the wheels so as to restrict air flow along said passage.

2. The sintering machine according to claim 1 wherein said casing structure has a further air seal to said grate cars, said further air seal isolating the interior of said casing structure from said partial vacuum beneath said grate cars.

3. The sintering machine according to claim 2 wherein suction means are connected to the interior of said casing structure to create a partial vacuum therein.

4. The sintering machine according to claim 1 wherein said flexible air seal comprises in combination a brush sealing element and a flap sealing element, said flap sealing element being fixed to said casing structure and lying against co-acting members on said grate cars.

5. The sintering machine according to claim 4 wherein said brush sealing element comprises a brush having bristles made of material selected from the group comprising polyurethane and stainless steel.

6. The sintering machine according to claim 1 wherein said blocking means has a longitudinal length such that at any time at least two of said wheels are present in said passage.

* * * * *